US005174909A

United States Patent [19]

Ward

[11] Patent Number: 5,174,909

[45] Date of Patent: * Dec. 29, 1992

[54] LATCHING BOLT MECHANISM AND MOUNT FOR CONCRETE FORMING SYSTEM

[75] Inventor: Philip T. Ward, Leawood, Kans.

[73] Assignee: Western Forms, Inc., Kansas City, Mo.

[ * ] Notice: The portion of the term of this patent subsequent to Oct. 22, 2008 has been disclaimed.

[21] Appl. No.: 603,409

[22] Filed: Oct. 26, 1990

Related U.S. Application Data

[62] Division of Ser. No. 466,967, Jan. 18, 1990, Pat. No. 5,058,855.

[51] Int. Cl.[5] ..... E04G 17/04; E04G 17/14

[52] U.S. Cl. ..... 249/44; 249/47; 249/166; 249/192; 249/196; 249/219.1

[58] Field of Search ..... 249/6, 44, 47, 165, 249/166, 167, 192-196, 219.1; 411/355, 358, 428, 534, 914; 292/57, 60, 62, 153, 163, 164, 181, 330, DIG. 58

[56] References Cited

U.S. PATENT DOCUMENTS

| | | | |
|---|---|---|---|
| 1,567,210 | 12/1925 | Trester | 249/191 |
| 2,117,560 | 5/1938 | Jennings | 249/196 |
| 2,297,899 | 10/1942 | Krueger | 249/45 |
| 2,825,956 | 3/1958 | Shoemaker | 249/191 |
| 3,121,277 | 2/1964 | Dusselier et al. | 249/40 |
| 3,123,887 | 3/1964 | Boettner | 249/192 |
| 3,166,818 | 1/1965 | Sakai et al. | 249/194 |
| 3,385,555 | 5/1968 | Williams | 249/192 |
| 3,578,369 | 5/1971 | Coopersmith et al. | 292/58 |
| 3,862,737 | 1/1975 | Fuston, Jr. | 249/196 |
| 3,877,674 | 4/1975 | Cerutti | 249/196 |
| 4,194,717 | 3/1980 | Easton et al. | 249/192 |

FOREIGN PATENT DOCUMENTS

| | | | |
|---|---|---|---|
| 1961949 | 6/1971 | Fed. Rep. of Germany | 249/195 |
| 2531463 | 2/1977 | Fed. Rep. of Germany | 249/196 |
| 2747064 | 5/1979 | Fed. Rep. of Germany | 249/196 |
| 2515716 | 5/1983 | France | 249/196 |

*Primary Examiner*—Jay H. Woo
*Assistant Examiner*—Khanh P. Nguyen
*Attorney, Agent, or Firm*—Wm. Bruce Day

[57] ABSTRACT

A latching bolt mechanism for fastening adjacent concrete form panels together to make a larger form work is disclosed. The mechanism includes a base permanently mounted on a form panel and a slidably attachable and detachable latching bolt mechanism having a tapered engagement pin for penetrating aligned apertures in the side rails of adjacent panel forms. The latching bolt further includes a tapered pin sleeve engaging portion that is received in the central bore of a pin sleeve, allowing transverse, shearing forces on the engagement pin to be readily dissipated. The pin sleeve in turn reciprocates within the central bore of a self-lubricating guide sleeve, which is seated within a housing block. A detachable mounting system includes a mounting bracket attached to the form panel and mating flanges on the housing block.

2 Claims, 4 Drawing Sheets

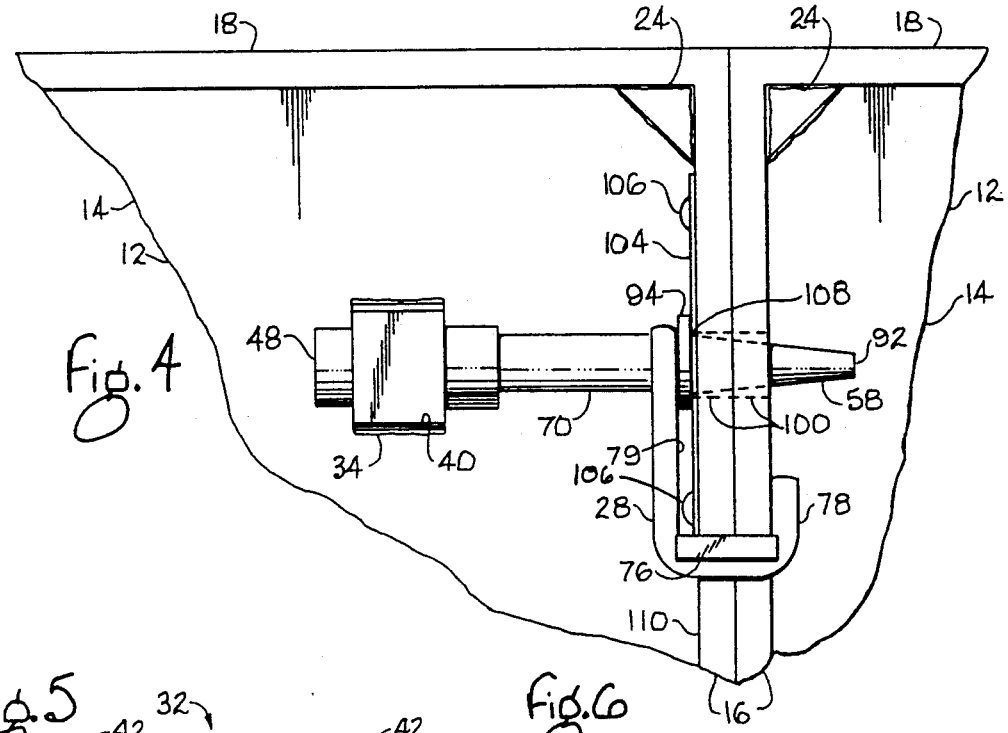
Fig. 4
Fig. 5
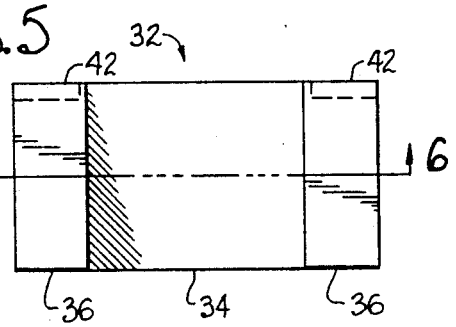
Fig. 6
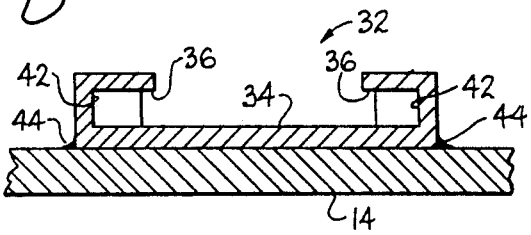
Fig. 7
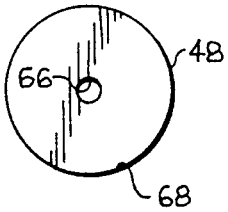
Fig. 8
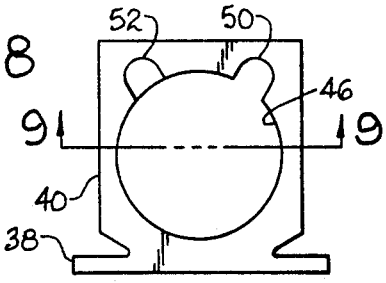
Fig. 9
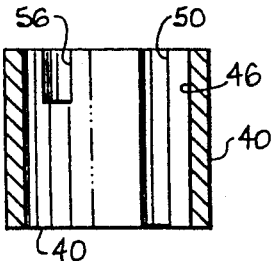

LATCHING BOLT MECHANISM AND MOUNT FOR CONCRETE FORMING SYSTEM

This is a division of application Ser. No. 07/466,967 filed Jan. 18, 1990, now U.S. Pat. No. 5,058,855.

BACKGROUND OF THE INVENTION

1. Field of The Invention

This invention relates to attachment hardware for fastening adjoining concrete form panels together for assembling forms for poured concrete. More particularly, the present invention relates to a latching bolt system that permits the latching bolt to be removed easily even when it is subjected to substantial transverse shearing forces that bind it in the receiving aperture.

2. Related Art

Prefabricated concrete forms are frequently manufactured into panels having a face sheet 3 feet×8 feet (0.9 m×2.5 m). Many panels must be linked together to form a concrete form work for a structure of any significant size. Typically, panels and other forming members are butted together along the long dimension, or side of the panels, and fastened together by a fastening means such as a bolt and nut, a hinged latch or other means, or a wedge and bolt, with a form tie between two adjacent form panels. The form tie extends from one side of the concrete wall to the other to keep the opposed form panels from spreading apart when the concrete is poured.

An example of such a wedge and bolt assembly for joining panel units is disclosed in U.S. Pat. No. 4,194,717, issued to Easton et al. on Mar. 25, 1980; however, other such attachment hardware devices preexisted the '717 patent.

Normally, a circumferential land or flange about the pin prevents the pin from penetrating the apertures too far. In some fastening systems the pin head includes a slot therethrough. A wedge may be driven into the slot to draw the pin fully into the apertures, wedging the wedge against one side rail and the flange against the other side rail of adjoining form panels with the form tie in between them to hold the pin firmly in place and prevent separation of the adjacent and adjoining panels. Typically, three or four such pins and form ties are employed to join two adjacent panels. The pin may be removably mounted on the rear side of the form panel by means of a mounting block that the pin slides through. The mounting block is typically bolted to the panel. The mounting block may be attached to a side rail or other portion of the rear side of the form panel by a base or mounting pad that is bolted to the form panel. The pin may have an overall length of about 12 inches (30 cm), with a pin head engaging portion comprising 2½ inches (6.4 cm), of which the first ½ to ¾ inches (1.3–1.9 cm) is tapered to assist in locating the pin in the holes during insertions. The remaining portion of the bolt is cylindrical, with the pin portion having a larger diameter than the bolt portion.

Such attachment hardware pins suffer from significant difficulties. As a first difficulty, it is exceedingly easy to misplace and/or damage the separate wedge pins required. Additionally, labor is used to connect the wedges to the pins. Further, when the form panels are aligned prior to pouring concrete, it may be relatively easy to align the holes or apertures in the side rails of the form panels and in the form ties and drive the pin into those holes by hammering on the back end of the bolt, but removing them can be extremely difficult.

The poured concrete, however, acts substantially like a fluid and develops significant hydrostatic head pressures throughout the concrete forms, which naturally become greater toward the bottom of the forms. The compressive loading on a concrete form 8 feet (2.5 m) high can easily reach 1,000–1,200 lbs. per square foot (420–506 kg/square meter). These forces may not be altogether evenly distributed. Moreover, the forces resisting them may not be evenly distributed throughout the concrete form panels, even among adjacent panels, as common bracing techniques on the rear of the panels may not be equally effective for adjacent panels. Consequently, the panels shift and spread somewhat relative to one another and relative to the opposed form panels, putting significant shear forces onto the pins of the attachment hardware.

Typically two spaced opposed parallel sets of forms are erected in order to pour a wall. Form ties are used to maintain the spacing between the opposed sets of forms. Typically the ties comprise strips of steel plate with one or more apertures toward each end. A plurality of ties link opposing form panels at each wall joint. The panel locking mechanism, such as a pin and a wedge, penetrates the side rail of one form panel, an aperture through the form tie, and a side rail of the adjacent form panel. These three elements are pulled together firmly by driving the wedge deeper into the pin slot. The hydrostatic forces generated by the poured concrete tend to spread the opposed form panels apart, but these outward or spreading forces are held in check by the for ties. In addition, the concrete expands as it sets, creating greater spreading forces. The pin is subject to a transverse pulling force by the form tie and an equal and opposed transverse outward pushing force by one or both adjacent form panels. Because the form tie is thin, these forces are quite close to each other, putting the pin into a significant bind. In a typical concrete wall, there may be about 7,000–8,000 lbs. (3,180–3,700 kg) tension or pulling force on each form tie. Because the only source of this force rises from counteracting the outward forces that otherwise would push the opposed form panels apart, the pin must be subject to equal outward forces, for a total transverse pin loading of about 14,000–16,000 lbs. (6,400–7,300 kg).

These forces tend to cause adjacent transverse cross sections of the pin to slip in opposite directions relative to one another, which defines a set of shearing forces on the pin. These shearing forces can make removing the pins very difficult, as the prior art pin has no way to relieve or release these shearing forces prior to removing the pin.

Consequently, removing the pins can be extremely difficult, often requiring an average of four to seven blows from a sturdy sledge hammer. The hammering can mushroom the pin point, causing interference with associated form tie apertures. In addition, the mushroomed pin points can easily shatter when struck with a hammer and may injure the worker. This requires much more additional labor than would be required if removal of the pins during disassembly of the form work were easy. In addition, the workers frequently damage or destroy the pins and significantly shorten the lives of the concrete form panel during disassembly of a form work.

In another problem, liquid from the poured concrete frequently splashes onto the rear sides of the forms.

Sometimes significant amounts of concrete are spilled onto the rear side of the forms. Standard operating procedure calls for all the concrete form panels and associated hardware to be sprayed with light machine oil prior to usage so that concrete spilled onto them may be easily removed. Often, however, this step is omitted or the oil is rubbed off by the workers during the process of assembling the form. When concrete spills or splashes onto the attachment hardware it naturally sticks to the attachment hardware as it sets up and makes disengaging the latching pin much more difficult. It can also make it difficult to drive the bolt through the housing. Much of the abuse the attachment hardware is subjected to arises from chipping off the concrete that sets up on the attachment hardware.

Accordingly, there is a need for attachment hardware for concrete forming systems that is easy to engage between adjacent form panels; easy to remove after the concrete has set and consequently does not suffer the abuse of prior art attachment hardware leading to decreased labor costs and longer life for the attachment hardware; that substantially eliminates problems associated with spilled concrete adhering to the attachment hardware and setting up; and that allows the latching mechanism to be readily replaced with a similar mechanism or a different type of fastening mechanism.

SUMMARY OF THE INVENTION

It is, therefore, the primary object of the present invention to provide a latching bolt mechanism for concrete forming systems that is easy to remove after the concrete has set for ready disassembly of the form work.

It is a further object of the present invention to provide a latching bolt mechanism for concrete forming systems that is easy to engage in adjacent form panels.

It is a further object of the present invention to provide a latching bolt mechanism for concrete forming systems that does not suffer the abuse of prior art attachment hardware.

It is a further object of the present invention to provide a latching bolt mechanism for concrete forming systems that leads to decreased labor costs in the disassembly of form works.

It is a further object of the present invention to provide attachment hardware for concrete forming systems that have a longer life because they can be removed from adjacent form panels without abuse.

It is a further object of the present invention to provide a latching bolt mechanism that substantially eliminates the problems associated with spilled concrete adhering to the latching bolt mechanism and setting up.

It is a further object of the present invention to provide a latching bolt mechanism that can be readily replaced on the form panel with a similar mechanism or a different type of fastening mechanism. 17 These and other objects of the present invention are achieved by providing a latching bolt mechanism for concrete form panels comprising a latching bolt having a tapered engagement pin with a small penetrating end and a larger engaging end defined by a land stop; means for releasing transverse shearing forces acting on the engagement pin; and means for mounting the latching bolt on a concrete form panel. The latching bolt mechanism further comprises a detachable mounting means so that the latching bolt mechanism or other attachment hardware may be readily mounted and dismounted from a concrete panel for service or replacement with the same or another type of attachment hardware.

The detachable mounting means comprises a mounting bracket or shoe fixed to a form panel by means such as welding, sad mounting bracket further comprising a flat base portion and a pair of opposed slide channels attached to the base. A latch bolt mechanism housing block comprising means for being seated in said mounting bracket and means for retaining said latching bolt in said mounting bracket permits quick replacement of the latching bolt mechanism at any specific location on a form panel. The housing block seating means further comprises a pair of opposed flat flanges attached to the lower portion of the housing block, the flanges being receivable by the slide channels of the mounting bracket.

The transverse shearing force releasing means for the engagement pin further comprises a pin sleeve engaging portion of the latching bolt, which is connected to and extends outwardly from said land stop of said latching bolt, the pin sleeve engaging portion or shaft being tapered from its largest size adjacent to said land stop to its smallest size at said distal end with a short untapered portion adjacent to the land stop; and a pin sleeve having a central cylindrical bore or aperture for receiving the pin sleeve engaging portion of the latching bolt.

The latching bolt mechanism further comprises a form clamp or a locking handle having a U-shaped locking portion for clamping the two adjacent side rails of two abutting form panels together.

The latching bolt mechanism further comprises a central bore in the housing block and a guide sleeve that reciprocates within the central bore of the housing block. The guide sleeve in turn has a central bore for receiving said pin sleeve for reciprocal and rotational motion. A compression spring seated within the central bore of the guide sleeve urges the engaging pin outwardly toward an engagement position. The guide sleeve further comprises an internal circumferential groove in said internal bore and an O-ring seated within said groove for retaining grease and for sealing the grease reservoir.

Similarly, the pin sleeve further comprises a circumferential groove its exterior surface that catches on the internal O-ring of the guide sleeve to prevent inadvertent disengagement of said pin sleeve.

The guide sleeve further comprises a locking key disposed on and fixed to the exterior surface of said guide sleeve and the housing block further comprises a means for receiving the locking key. The receiving means in the housing block comprises a keyway that penetrates the length of the housing block, allowing the guide sleeve to be disengaged from the housing block and the entire latching mechanism then can be disassembled. A blocked keyway, i.e., a separate keyway, within the housing block, prevents the key from being disengaged and therefore prevents disassembly of the latching bolt mechanism while it is in place on a concrete form panel.

These and other objects of the present invention will become apparent from the following description taken in connection with the accompanying drawings, wherein is set forth by way of illustration and example, an embodiment of this invention.

BRIEF DESCRIPTION OF THE DRAWINGS

FIG. 4 is a rear plan view of the latching bolt mechanism according to the present invention shown in the fully engaged and locked position in use with two abutting form panels.

FIG. 5 is a top plan view of a mounting bracket for use with the latching bolt mechanism.

FIG. 6 is an end elevation of the mounting bracket of FIG. 5 shown attached to the rear side of the panel form face sheet.

FIG. 7 is a rear elevation of a guide sleeve of the latching bolt mechanism.

FIG. 8 is an end elevation of the latching bolt mechanism housing block. 17 FIG. 9 is a sectional view taken along lines 9—9 of FIG. 8.

DETAILED DESCRIPTION OF THE PREFERRED EMBODIMENT

As required by the statutes and case law, a detailed embodiment of the present invention is disclosed herein. It is, however, to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
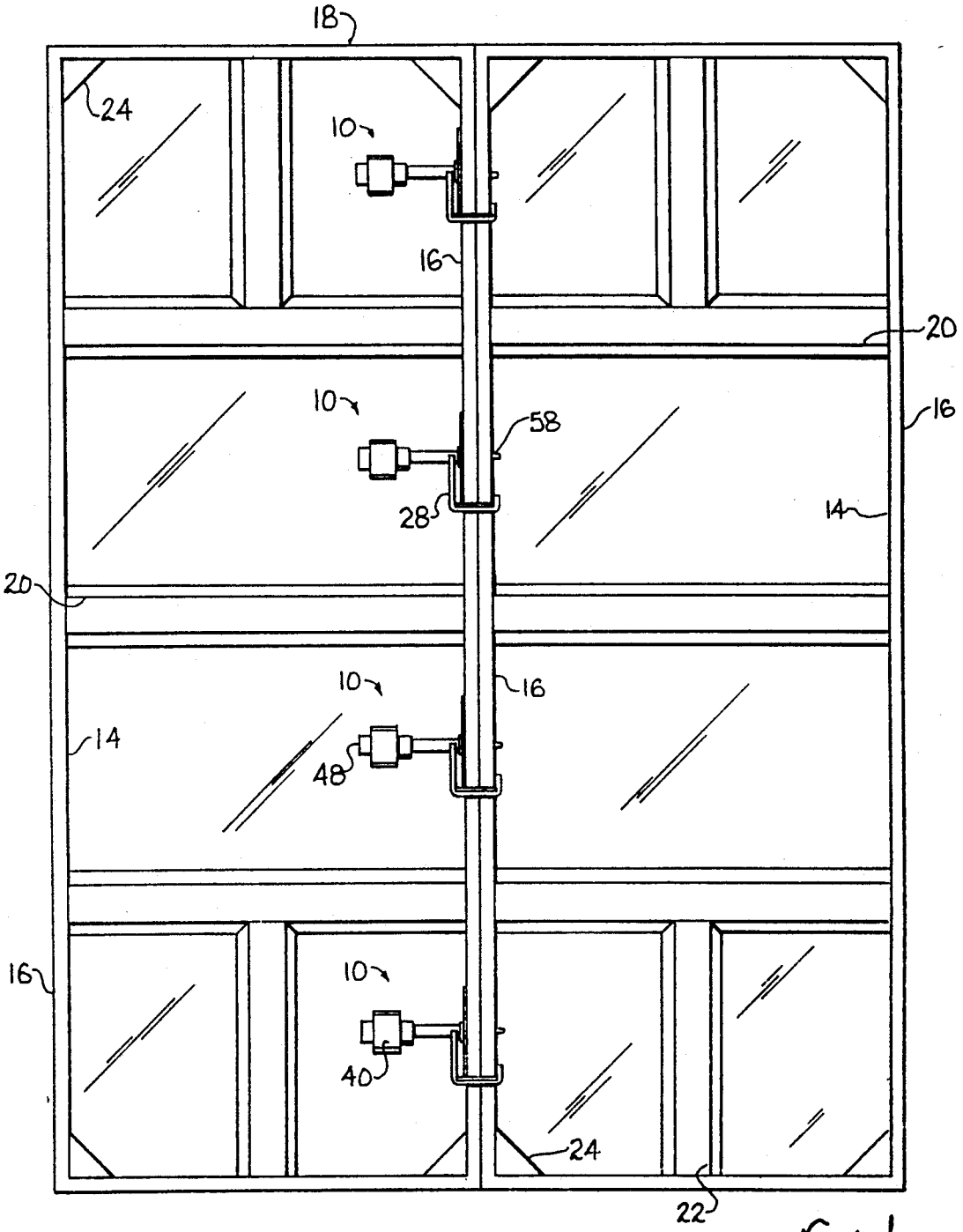
FIG. 1 is a rear plan view of two adjacent concrete panel forms joined together by four latching bolt mechanism according to the present invention.

Referring to FIG. 1, there are shown two concrete panel forms 12 fastened together by four fully engaged and locked latching bolt mechanisms 10. The concrete form panel comprises a polygonal face sheet having a rear side and a face side and at least one boundary edge, with at least one rail fixed to the rear side of the face sheet to form a panel. The rail is mounted adjacent to the boundary edge and fixed thereto. A mounting means or bracket 32 for the latching bolt mechanism 10 is attached to the rear side of the panel by welding and the like. More particularly, each concrete form panel 12 includes a face sheet 14 having a rear side 15 to which all reinforcing members and attachment hardware are attached. The face sheet 14 may be rectangular and, for example, is about 3 feet×8 feet (0.9×2.5 m) and includes a pair of opposed side rails 16 mounted adjacent to the long edges of the face sheet 14 and a pair of opposed end rails 18 mounted on the short edges of the face sheet 14 and fixed thereto by welding. Cross-ribs 20 provide reinforcement of the face sheet 14 and are disposed parallel to the end rails 18 and perpendicular to the side rails 16 and are welded into place. The longitudinal reinforcing members 22 provide further reinforcement, as do the corner gussets 24. The face sheet 14, the side rails 16, the end rails 18, the cross-ribs 20, the longitudinal reinforcing members 22, and the corner gussets 24, are all preferably made of aluminum, which has been found to provide the most desirable strength-to-weight ratio combined with inexpensive manufacturing costs and durability.

Still referring to FIG. 1, each latching bolt mechanism 10 includes an engagement pin 58 that penetrates an aperture in the side rail 16 of each concrete form panel 12 for holding two adjoining panels together. The engagement pin 58 also penetrates an aligned aperture in the thin form tie (not shown). A locking handle 28 includes a U-shaped locking portion 30 sized to fit tightly across the two adjacent side rails 16, providing further means for securing the two adjoining panels together. The specific operation of the latching bolt mechanism 10 is disclosed below in conjunction with more detailed drawing FIGS.

Figure 10:
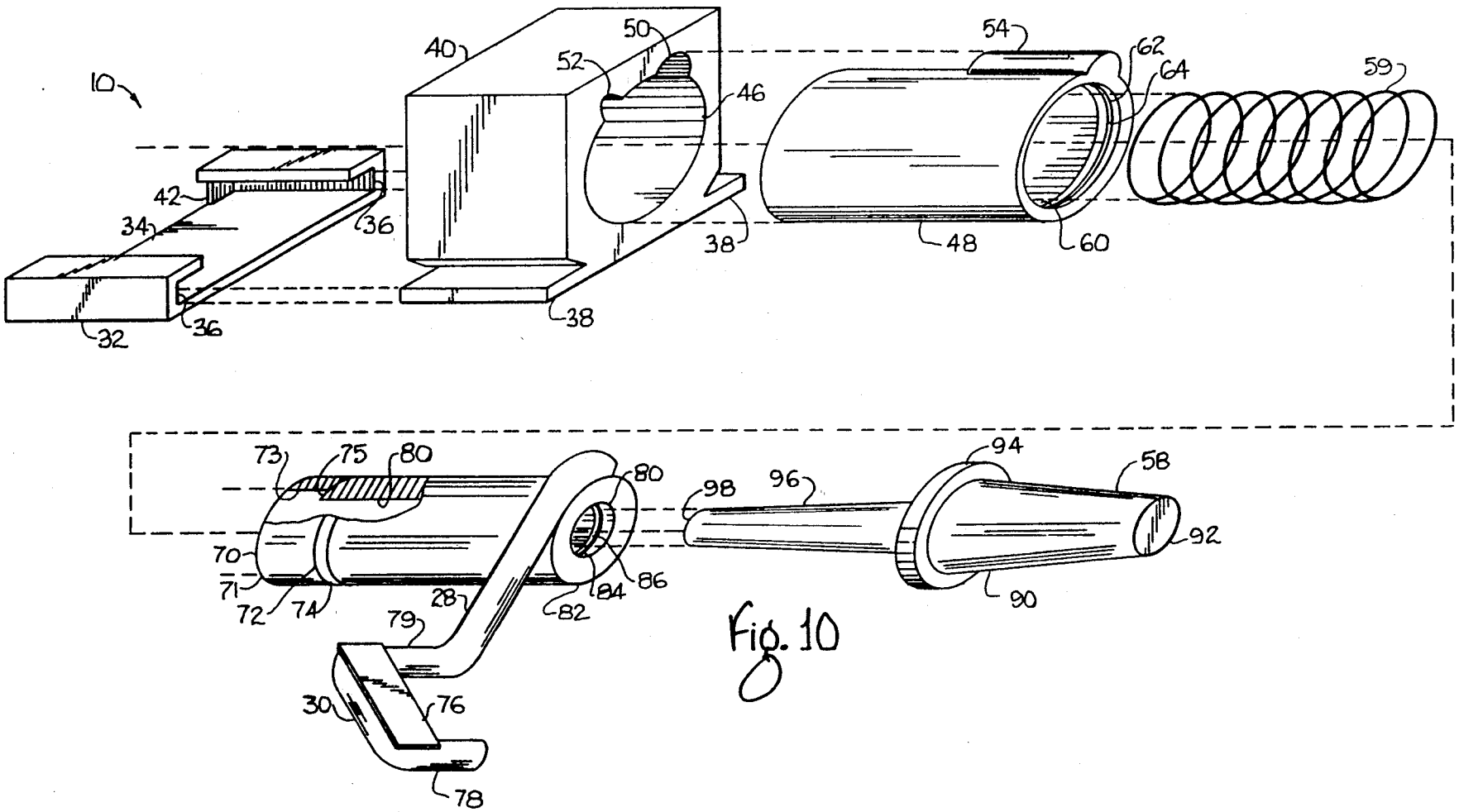
FIG. 10 is an disassembled perspective view of the latching bolt mechanism.

Referring now to FIG. 10, there is shown an disassembled view of the latching bolt mechanism 10. The nature of the parts will be discussed in reverse order of normal assembly, that is, starting on the top row and moving from the left to the right of the drawing sheet and then dropping to the bottom row and continuing to move from left to right. A mounting bracket 32 is intended to be welded to the rear side of the face sheet 14 to allow the working assembly of the latching bolt mechanism 10 to be easily and quickly removed without tools for servicing, repair, or replacement. The form panel may be manufactured with the bracket 32 or shoe welded in place but without the latching bolt mechanism itself. The user can easily use other attachment hardware, such as conventional wedge-pins and delay purchase of the more expensive latching bolt mechanism described herein until funds permit. Then the latching bolt mechanism can be readily installed in the pre-existing shoes or mounting brackets 32 without tools or welding or additional machine work, thereby reducing the cost of attachment hardware upgrades.

The mounting bracket 32 or shoe includes a flat base portion 34 and two channels 36 for accepting and receiving the mounting flanges 38 of the housing block 40. A stop 42 is formed at the rear of one or both channels 36 to prevent the mounting flanges 38 from slipping through the mounting bracket 32 while the latching bolt mechanism 10 is in use. The latching bolt mechanism thus can be removed from the mounting bracket by moving the latching bolt mechanism 10 toward the side rail 16 of a form panel 12, that is, toward to right-hand side of FIG. 10. The mounting bracket 32 is preferably made from extruded aluminum and the stop 42 is a small flange element welded to close the channels 36.

Referring to FIG. 5, there is shown a top plan view of the mounting bracket 32. FIG. 6 provides a rear elevation of the mounting bracket 32 attached to the face sheet 14 of a concrete form panel 12 by weldments 44.

Returning to FIG. 10, the next part of the latching bolt mechanism 10 is the housing block 40, which is an integrally formed aluminum extrusion including the mounting flanges 38. A relatively large central aperture 46 accommodates the cylindrical guide sleeve 48 for reciprocal motion therein. The housing block 40 further includes a keyway 50 shaped to match the essentially cylindrical key 54 of the guide sleeve 48, which allows the guide sleeve 48 to pass through the mounting block 40 toward the left of FIG. 10, that is, the rear of the latching bolt mechanism 10 for disassembly. A blocked keyway 52 includes a stop 56 (see FIG. 9).

For partial removal of the latching bolt mechanism 10, the guide sleeve 48 is retracted from the housing block 40 by pulling it to the right in FIG. 10, twisting the guide sleeve 48 about its longitudinal axis, or centerline, which is indicated by the dashed line in FIG. 10, until the key 54 is aligned with the blocked keyway 52. Then the guide sleeve 48 is inserted into the housing block 40. The key 54 is blocked by the stop 56 from passing through the housing block 40 to the rear, or left as illustrated in FIG. 10. In this position, the compression spring 59 insures a firm and positive engagement through the side rail 16 by the pin 58.

Still referring to FIG. 10, the guide sleeve 48 further comprises a relatively large cylindrical bore 60 for receiving the compression spring 59 and the pin sleeve 70. An internal circumferential groove 62 contains a conventional 0-ring, which may be made of neoprene or the like.

The rear side wall 68 of the guide sleeve 48, the bore 60 and the hardware received within the bore 60 form a lubrication reservoir for receiving a lubricant through the aperture 66 of the rear side wall 68 and retaining the lubricant therein. The received hardware comprises the pin sleeve 70 and the latching bolt pin sleeve engaging portion or shaft 96. Any convenient lubricant such as heavy grease, light oil, or silicon lubricant may be used, as desired. The preferred lubricant, however, is a heavy grease, such as automobile wheel bearing grease because it tends to remain useful and within the reservoirs longest (a second lubricant reservoir being formed within the central bore 80 of the pin sleeve 70). The lubricant naturally lubricates the parts of the latching bolt mechanism 10 for easier relative movement of the parts, and also prevents spilled concrete from adhering to the parts, making disassembly of the concrete form easier. The second lubricant reservoir formed in the central bore 80 in the pin sleeve 70 also receives its lubricant through the aperture 66 in the rear side wall 68 of the guide sleeve 48.

Referring to FIG. 7, there is shown a rear elevation of the guide sleeve 48, which includes a bleeder aperture 66 in the rear side wall 68, which prevents the compression spring 58 and other parts from passing through the rear side, or end of the guide sleeve 48, that is toward the left-hand side of FIG. 10. The pin sleeve 70 has a cylindrical outer surface that fits within the cylindrical bore 60 of the guide sleeve 48 and reciprocates and rotates therein. Grease or other lubricant is introduced into the guide sleeve 48 through the bleeder aperture 66 to lubricate the assembly and to prevent splashed or spilled concrete from sticking to it during use. Naturally, the grease is carried on the inner surface of the cylindrical bore 60 and the outer surface of the pin sleeve 70 and into the bore 80 of the pin sleeve 70 as these parts reciprocate relative to one another. Further, as these parts reciprocate, air enters into and escapes from the bleeder aperture 60, since the pin sleeve 70 and the central bore 60 act like a piston and a cylinder respectively.

Still referring to FIG. 10, there is next shown the pin sleeve 70 having a cylindrical outer surface that includes a circumferential groove 72 for engaging the 0-ring 64, which is seated in the groove 62 of the guide sleeve 48 and acts as a grease seal. The engagement of the pin sleeve groove 72 with the 0-ring 64 of the guide sleeve 48 when the pin sleeve projects outwardly of the guide sleeve 48 prevents inadvertent disengagement of the pin sleeve 70 from the guide sleeve 48. The central bore 80 of the pin sleeve 70 is cylindrical and penetrates the entire length of the pin sleeve 70, leaving the back end 71 open to and in fluid communication with the cylindrical bore 70 of the guide sleeve 48, which allows the internal bore 80 of the pin sleeve 70 to act as a lubricant reservoir. The oil, grease, silicon lubricant or other lubricant that is applied to the lubricant reservoir formed by the internal bore 60 or chamber of the guide sleeve 48 by the pin sleeve 70 and the rear side wall 68 of the guide sleeve 48 can readily reach the interior of the cylindrical bore 80 of the pin sleeve 70, where it also lubricates the shaft 96 of the latching bolt 90.

The pin sleeve 70 further comprises the well 73 formed in the rear end 71 and comprising a circumferential land 75 within the bore 80. The well 73 is formed by forming a shallow bore in the end 71 of the pin sleeve 70 that has a larger diameter than the bore 80 in which the shaft 96 of the latching bolt 90 reciprocates. The compression spring 59 is seated within the well 73, enabling the compression spring 59, which also bears against the inside of the rear side wall 68 of the guide sleeve 48, to urge the pin sleeve 70 and the latching bolt 90 into engagement in the apertures 100 of the side rails 16.

A bent locking handle 28 is attached to the forward or right-hand end of the pin sleeve 70 as illustrated in FIG. 10 by welding or other convenient means. The locking handle 28 further comprises a U-shaped locking portion 30 having a gusset 76 welded thereto to provide additional mechanical strength and reinforcement. The U-shaped handle portion 30 forms a bracket that fits adjoining side rails 16 of adjacent concrete form panels 12 snugly within the opposed parallel handle portions 78, 79. The handle 28 and the pin 58 acting in concert hold the adjacent form panels 12 together securely.

Still referring to FIG. 10, the pin sleeve 70 further includes an internal central bore 80 along the longitudinal axis which is cylindrical, or centerline, of the pin sleeve 70 as indicated by the heavy dotted line. Interior of the right-hand end 82 the internal circumferential groove 84 in which the 0-ring 86 is seated. The 0-ring 86 acts as a grease seal and as a means for retaining the pin sleeve engaging portion or shaft 96 of the latching bolt 90.

Still referring to FIG. 10, there is also shown the last or final piece of the latching bolt mechanism 10, namely the latching bolt 90, which comprises a uniformly tapered engagement pin 58 that is tapered from the small size penetrating end 92 to the largest size at the land stop 94. The degree of taper illustrated in FIG. 10 is exaggerated to render it more readily visible. This taper makes it easier to insert the engagement pin 58 into the aperture of a panel side rail and automatically makes it easier to remove the pin by decreasing the friction from the transverse or side forces such as transverse shearing forces that the pin 58 is subjected to. Each hammer blow that moves the pin 58 away from engagement in the side rails 16, that is, from the right to the left as illustrated in the figures, creates greater transverse slack between the pin 58 and the apertures in the side rails 16 and the form tie.

The land stop 94 is of greater diameter than the aperture 10 through which the pin 58 is thrust, thereby preventing the pin 58 from penetrating the aperture more than the specified distance. The land stop 94 is held firmly against the side rail 16 by the clamping handle 28 which is rotated into the clamping position illustrated in FIG. 4 during form work set up and is moved to the non-locking position illustrated in FIG. 3 during disassembly of the form work, prior to removing the pin 58 from the form panels 12. The engagement pin 58, the land stop 94, and the pin sleeve engaging portion or shaft 96 of the latching bolt 90 all have circumferential cross sections where the section is taken along a line perpendicular to the longitudinal axis. The locking bolt 90 may be assembled from three different pieces or from a single steel rod formed on a cold header machine.

Still referring to FIG. 10, the latching bolt 90 further includes the latching bolt shaft or pin sleeve engaging portion 96, which is tapered from the largest land stop 94 to the smaller distal end 98, except for a ½ inch (1.27 cm) cylindrical portion adjacent to the land stop 94 which maintains good contact with the 0-ring 86. The internal central bore 80 of the pin sleeve 70 is cylindrical so that when the pin sleeve engaging portion or shaft 88 is fully engaged within the bore 80 the shaft 96 is held in place by the 0-ring 86. The internal central bore 80 and the pin sleeve engaging portion or shaft 96 of the latching bolt 90 are also lubricated with heavy grease to prevent concrete splashings from sticking to them and to lubricate the pieces for easier relative movement.

The housing block 40 and the guide sleeve 48 may be consolidated into a single component, which could facilitate manufacture. The housing block 40, the guide sleeve 48 and the pin sleeve 70, along with the associated hardware comprise a housing means whose purpose is to provide relatively smoother reciprocal and rotational relative motion between the latching bolt 90 and the housing means or housing assembly. The fact that the housing assembly can move and rotate independently of the latching bolt 90 provides the ease of operation discussed herein. In addition, the pin 58 portion of the latching bolt 90 can be made of much harder steel than a conventional pin because so much less force is required for its removal. This eliminates the mushrooming problem.

Figure 2:
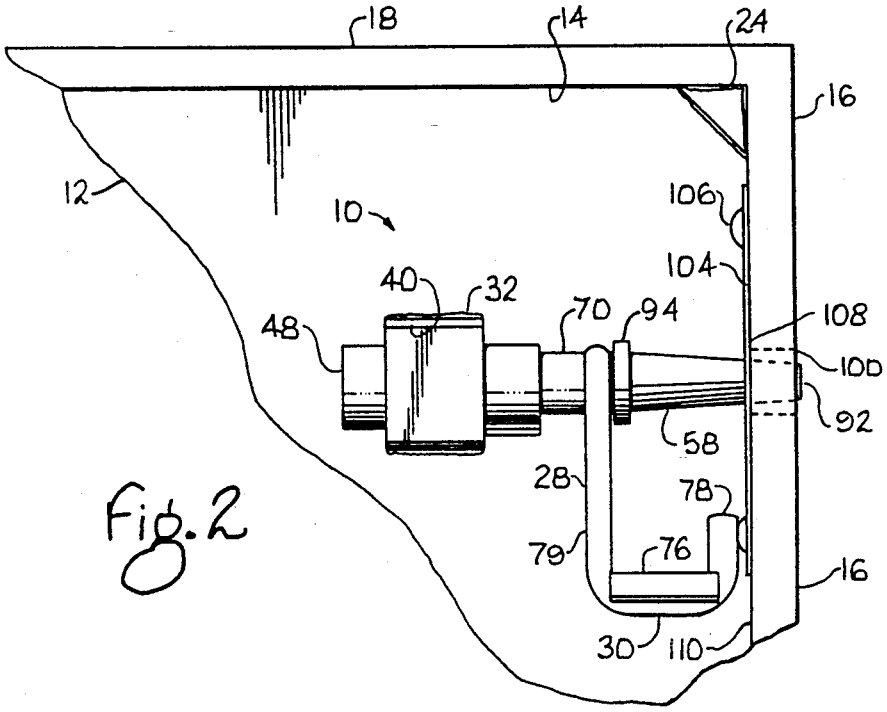
FIG. 2 is a rear plan view of the latching bolt mechanism shown in the retracted or storage position in use on a form panel.

Referring now to FIG. 2, there is shown the latching bolt mechanism 10 in the retracted or storage position with the penetrating end 92 of the pin 58 barely projecting through the aperture 100 of the side rail 16. The handle is rotated from an upstanding position perpendicular to the face sheet 14 to a position below the horizontal where the end 78 of the handle 28 engages the side wall of the side rail 16. The compression spring 59 is compressed, keeping the handle 28 in this storage position. The compression spring 59 is strong enough that vibration from handling and shipping of a panel 12 with the latching bolt mechanism 10 attached will not jar the handle 28 into the open position.

Referring to FIG. 4, there is shown the latching bolt mechanism 10 in the engaged and secure position for retaining two concrete form panels 12 together to make a larger form work. The pin 58 is fully engaged so that the land stop 94 abutts the reinforcing plate 104 of the side wall 110 of the side rail 16. The reinforcing plate 104 is held in place by the rivets 106 and includes an aperture 108 aligned with the aperture 100 in the side rail. The reinforcing plate 104 may include a slight spring-action in that the reinforcing pate 104 may have a slight bulge in it away from the side wall 110 of the side rail 16 in the relaxed position. This moderately facilitates disengagement of the latching bolt 90. The handle 28 can be rotated into and between the various positions illustrated herein because the pin sleeve 70 is free to rotate within the central bore 60 of the guide sleeve 48, as well as to reciprocate within it. In the position illustrated in FIG. 4, the compression spring 59 still exerts significant engaging force urging the pin 58 to the fully engaged position and keeping it there, and the clamping action of the U-shaped handle portion 30 of the locking handle 28 further secures the connection of the two adjoining panels 12.

When the latching bolt mechanism 10 is to be left on the form panel 12, the key 54 of the guide sleeve 48 is engaged in the blocked keyway 52 of the housing block 40, preventing disassembly. If the handle 28 is moved linearly to the rear, that is, to the left in the figures, as far as possible, it will strike the end of the guide sleeve 48 that carries the key 54, which stops the handle 28 in a position that still does not allow for disassembly of the latching bolt mechanism 10.

Figure 3:
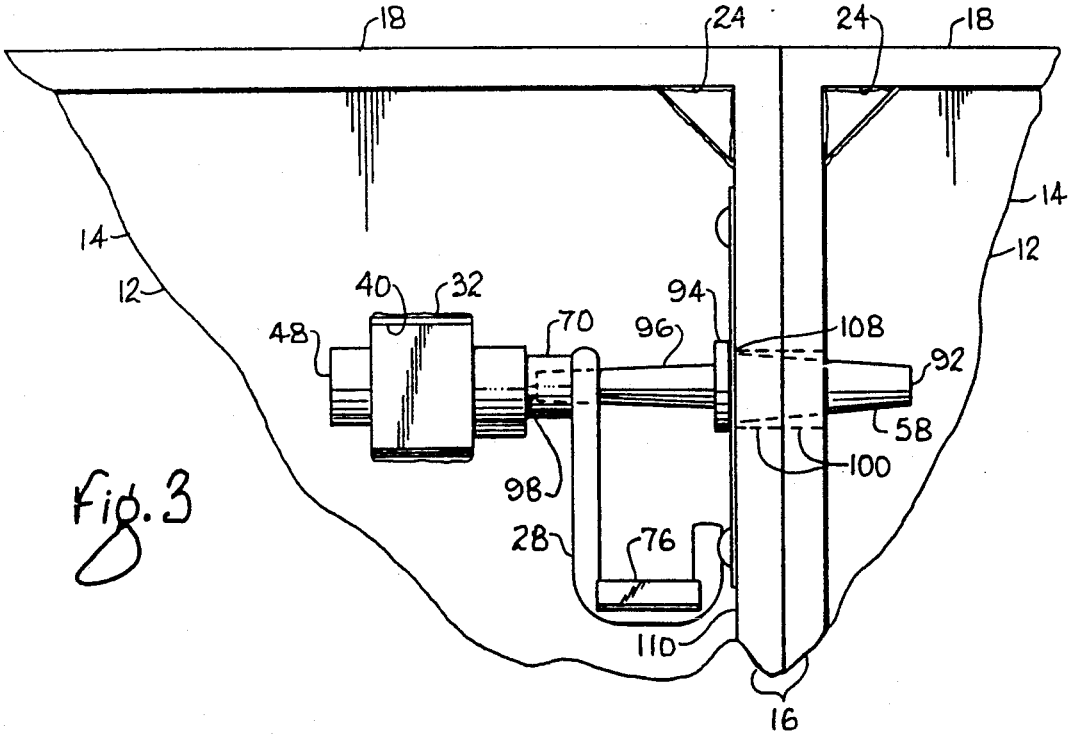
FIG. 3 is a plan view of the latching bolt mechanism according to the present invention shown in an intermediate stage of dlsassembling a form work when the pin is subjected to shearing forces.

Referring to FIG. 3, there is shown a significant step in the process for removing the latching bolt mechanism 10 after concrete has been poured in the form and has set. The two tapers discussed above allow for easy removal of the pin 58. First, the handle 28 is moved from the locked and engaged position shown in FIG. 4 to the storage position shown in FIG. 2, that is, abutting the side wall 110 of the side rail 16. This is easy to accomplish because the transverse shearing forces or friction bearing on the pin 58 is not significantly transferred to either the pin sleeve 70 or the guide sleeve 48. Moreover, such forces are not effectively transmitted to the shaft end 96 of the latching bolt 90, except that the shaft 96 may be cocked very slightly out of longitudinal axial alignment with the centerline of the latching bolt mechanism 10. Thus the lubricated pin sleeve 70 can easily be retracted into the guide sleeve 48 where it is held by the handle 28 bearing against the side rails 16 of two adjacent form panels as shown in FIG. 3, while the latching bolt 90 remains wedged or bound into the apertures of the side rails 16. This step could be achieved even if the shaft 96 were perfectly cylindrical. Because, however, the shaft 96 is tapered, slack is developed between the shaft 96 and the central bore 80 of the pin sleeve 70 when the pin sleeve 70 is retracted. The farther the pin sleeve 70 is retracted, the greater the slack. This allows the latching bolt 90 to wiggle or wobble within the bore 80, relieving much of the shearing forces on the pin 58 by allowing the latching bolt 90 to pivot slightly about the transverse point of application of the opposed transverse shearing forces, thereby reducing them. Then the tapered end of the pin 58 allows the latching bolt 90 to be driven out of engagement with the form panel side rails 16 relatively easily. The fact that the latching bolt 90 and the mechanism for holding it in place are not rigidly coupled makes it much easier to remove the pin 58 when the concrete is set. If the pin 58 is not in a bind due to shearing forces applied to the pin 58, the latching bolt 90 will retract easily, allowing the latching bolt mechanism 10 to be placed in the storage position illustrated in FIG. 2. If, however, significant shearing forces are applied to the pin 58, then the position illustrated in FIG. 3 will obtain, namely that the pin sleeve 70 will retract due to the taper of the shaft 96 relative to the internal central cylindrical bore 80 of the pin sleeve 70, while the latching bolt 90 remains fully engaged. This position introduces a gap between the bore 80 of the pin sleeve 70 and the pin sleeve engaging portion 96 of the latching bolt 90. The distance of the gap that can be opened between these two surfaces is frequently enough to wholly alleviate the shearing forces on the pin 58, allowing it to be easily disengaged by a tap from a hammer on the penetrating end 92 (see FIG. 10) of the pin 58 is sufficient to disengage the pin 58.

It is to be understood that while certain forms of this invention have been illustrated and described, it is not limited thereto, except and insofar as such limitations are included in the following claims.

What is claimed as new and is desired to be protected by Letters Patent is as follows:

1. A latching bolt mechanism for concrete form panels comprising:

a) a latching bolt having an engagement pin:

b) means for releasing transverse shearing forces acting on said engagement pin;

c) means for detachably mounting said latching bolt on a concrete form panel;

d) said detachable mounting means including a mounting bracket for fixing to said concrete form panel with said mounting bracket comprising a flat base portion and a pair of opposed slide channels attached to sad base; and e) a housing block including means reciprocally retaining said latching bolt and means for seating in said mounting bracket.

2. A latching bolt mechanism for concrete form panels comprising:

a) a latching bolt having an engagement pin for connecting adjoining concrete form panels;

b) housing means reciprocally retaining said latching bolt; and c) mounting means connected to said housing means and having portions for detachable connection to a concrete form panel; said mounting means including a slide channel connective to said concrete form panel and slide flanges extending from said housing means and receivable into said slide channel.

* * * * *